US008399788B2

(12) United States Patent
Goupil

(10) Patent No.: US 8,399,788 B2
(45) Date of Patent: Mar. 19, 2013

(54) MECHANICAL ACTIVATOR FOR CONTACTOR

(75) Inventor: Bruno Goupil, Beaconsfield (CA)

(73) Assignee: Tornatech Inc., Montreal (CA)

( * ) Notice: Subject to any disclaimer, the term of this patent is extended or adjusted under 35 U.S.C. 154(b) by 181 days.

(21) Appl. No.: 13/150,755

(22) Filed: Jun. 1, 2011

(65) Prior Publication Data

US 2011/0290627 A1 Dec. 1, 2011

Related U.S. Application Data

(60) Provisional application No. 61/350,207, filed on Jun. 1, 2010.

(51) Int. Cl.
*H01H 25/00* (2006.01)

(52) U.S. Cl. ..... 200/337

(58) Field of Classification Search ..... 200/337, 200/332.1, 543–546, 537, 564–565, 43.01, 200/11 R, 11 A, 11 D, 11 DA, 11 J, 11 TW, 200/567–569, 571, 336

See application file for complete search history.

(56) References Cited

U.S. PATENT DOCUMENTS 6,506,984 B2 * 1/2003 Tomita ..... 200/11 R
6,578,447 B1 * 6/2003 Fraser ..... 74/527
8,173,923 B2 * 5/2012 Lee et al. ..... 200/543

* cited by examiner

*Primary Examiner* — Edwin A. Leon
(74) *Attorney, Agent, or Firm* — Goudreau Gage Dubuc; Gonzalo Lavin

(57) ABSTRACT

A mechanical asymmetrical activator for electrical contactors in the manufacturing of fire pump controllers comprising a flexible cable and pulley system wherein the pulling of the flexible cable engages the pulley system to activate contactor. The activator comprises a compound pulley assembly comprising a first pulley with a fixed axle and a second pulley with a free axle, an arm in cooperation with the free axle and adapted to engage the contact carrier of a contactor and a plurality of mounting attachments for engaging the auxiliary contactor mounting points of a contactor.

4 Claims, 6 Drawing Sheets

MECHANICAL ACTIVATOR FOR CONTACTOR

CROSS REFERENCE TO RELATED APPLICATIONS

This application claims benefit, under 35 U.S.C. §119(e), of U.S. provisional patent application Ser. No. 61/350,207, filed on Jun. 1, 2010, which is incorporated herein in its entirety by reference.

FIELD OF THE INVENTION

The present invention relates to a mechanical activator for contactors in fire pump controllers. In particular, the invention relates to the use of asymmetrical activation of an electrical contactor via a flexible cable and pulley system in the manufacturing of fire pump controllers.

BACKGROUND OF THE INVENTION

Current fire pump system standards require an external mechanical means to activate an electrical contactor to supply power to a fire pump motor. In the event of electrical component failure in a fire pump controller, whereby an electromagnetically operated contactor is unable to close its contacts under normal operating conditions, the external mechanical means is required for a user to manually close the contacts and start the fire pump motor.

To meet the fire pump system standards, fire pump manufacturers have designed a variety of mechanical systems to activate contactors. Depending of the starter model, activation of one contactor or two contactors may be required. For example, an across-the-line starter requires the activation of one contactor whereas a wye-delta starter requires the simultaneous activation of two contactors. Such mechanical activation is further subject to other requirements. In particular, the mechanical activation cannot interfere with the electromagnetic activation of the contactor; the mechanical activation system must be independent of the electromagnetic activation and vice versa; the electromagnetic activation should not be comprised of any mechanical components that can cause an increase of inertia for contactor parts in motion; the mechanical system should be accessible from the exterior of the controller; and the movement of a mechanical activator should follow one direction only. The latching of the system is an option of the user.

Currently, most fire pump controllers are equipped with a mechanical linkage system to activate the contactor manually. Such mechanical linkage systems operate by pushing the carrier of the contactor's armature via an aperture in the top or sides of a contactor. However, such prior art linkage systems are rigid and require perfect alignment of the mechanical linkage for proper activation. Additionally, activation of a contactor via its top requires space in the fire pump controller cabinet above where the contactor is mounted to accommodate a mechanical linkage. Still additionally, activation of a contactor via its sides requires sufficient space around the contactor and excellent alignment of mechanical parts.

What is therefore needed, and an object of the present invention, is an improved mechanical system for activating a contactor that alleviates the requirement of precisely aligned equipment. What is additionally needed, and another object of the present invention, is an improved mechanical system for activating a contactor using a flexible cable and pulley system that is easily deployable in space limited applications such as fire pump controller housings. Still additionally, there is needed an asymmetrical activator capable of simultaneously activating two adjacent contactors.

SUMMARY OF THE INVENTION

In order to address the above and other drawbacks, there is provided in accordance with the present invention a pulley system for a fire pump controller contactor activated via a flexible cable. The pulley system is fixed on the contactor using the contactor grips for side auxiliary contacts.

In accordance with the present invention, there is also provided a pulley system for a fire pump controller contactor for mechanically activating a group of two contactors using the same pulley system.

DESCRIPTION OF ILLUSTRATIVE EMBODIMENTS

The present invention is illustrated in further details by the following non-limiting examples.

Figure 1:
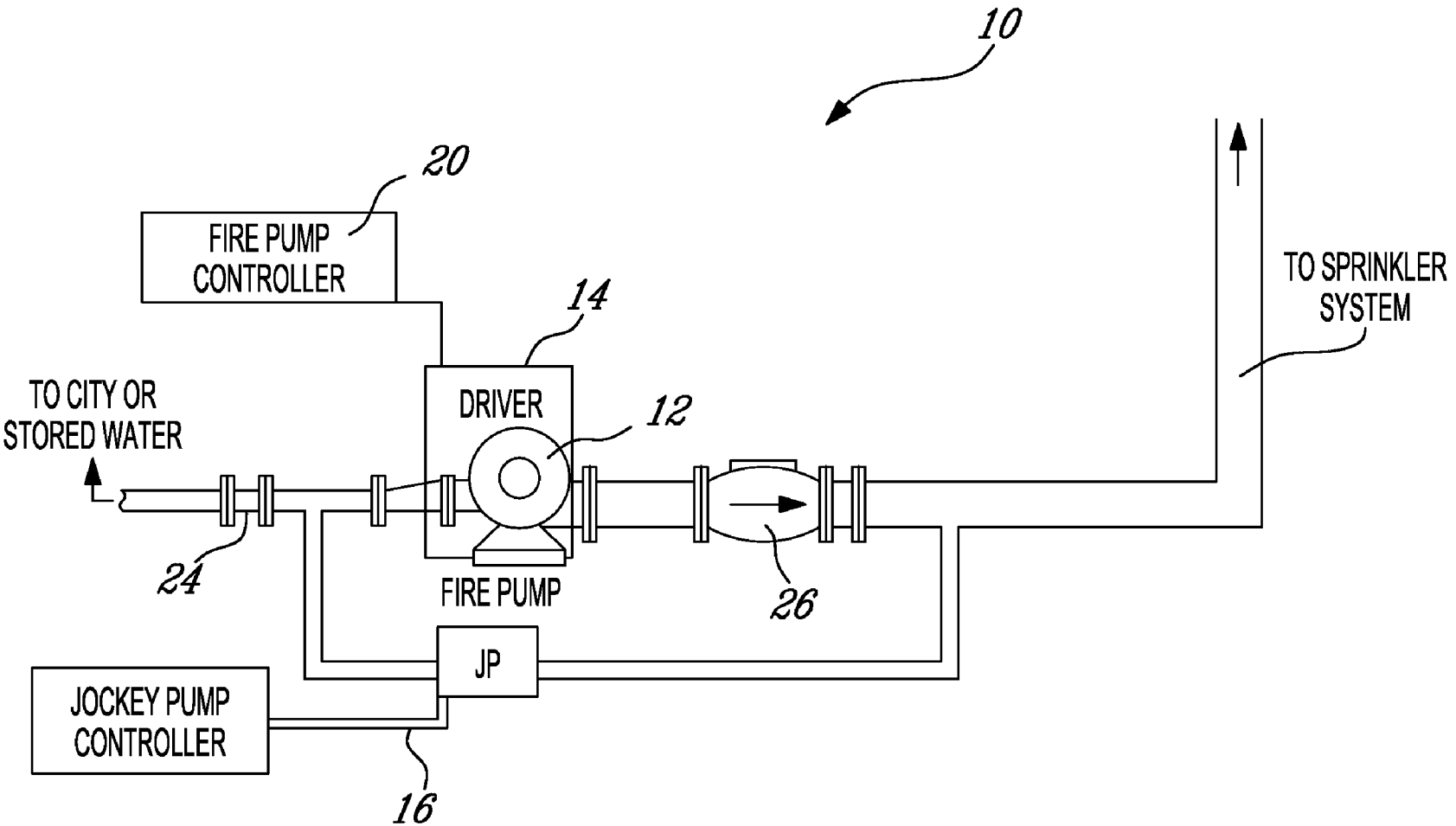
Fig. 1 (PRIOR ART)
FIG. 1 is a system view of a prior art fire pump system.

Referring now to FIG. 1, a fire pump system, generally referred to using the reference numeral 10, will now be described. The fire pump system 10 comprises a fire pump 12 illustratively having a rating between 5 and 400 horsepower (HP), an electric motor (driver) 14, and a fire pump controller 20 all linked together to piping to provide and maintain a predetermined water pressure to a sprinkler system (not shown). The fire pump system 10 acts to supply and regulate water flow from a water supply (not shown) through a supply valve 24 and a check valve 26 to the sprinkler system, which has one or more discharge devices (not shown). Should a pressure loss due to a sprinkler opening occur, the fire pump 12 is activated by the fire pump controller 20 which throws a contactor 22 located within the fire pump controller 20 to allow power from a power source (not shown) to be supplied to the fire pump 12 so that additional water may be pumped from the water supply to the sprinkler system. The fire pump controller 20, in accordance with an illustrative embodiment of the present invention, is typically utilized in fire pump systems 10 to control operation of the fire pump 12 by detecting a drop in system pressure indicative that a sprinkler head (not shown) of the sprinkler system has been activated as a result of a fire. The fire pump controller 20 then performs the necessary sequential operations to activate the pump driver 14 to pump water through the system 10. The controller 20 then maintains a predetermined volume of water and pressure to control or defeat the fire.

Still referring to FIG. 1, the fire pump controller 20 and all of its internal components are sized to accommodate the power requirements of the fire pump 12 and its electrical driver 14. Such internal components housed within the controller 20 are either power related components or control related components. Despite control components meeting ruggedized industrial component specifications, failure of such components may still occur. As a backup measure to such a control circuitry failure, the fire pump controller 20 is therefore equipped with an emergency mechanism, such as a mechanical lever, to mechanically operate the contactor and thereby start the fire pump driver 14.

Figure 2:
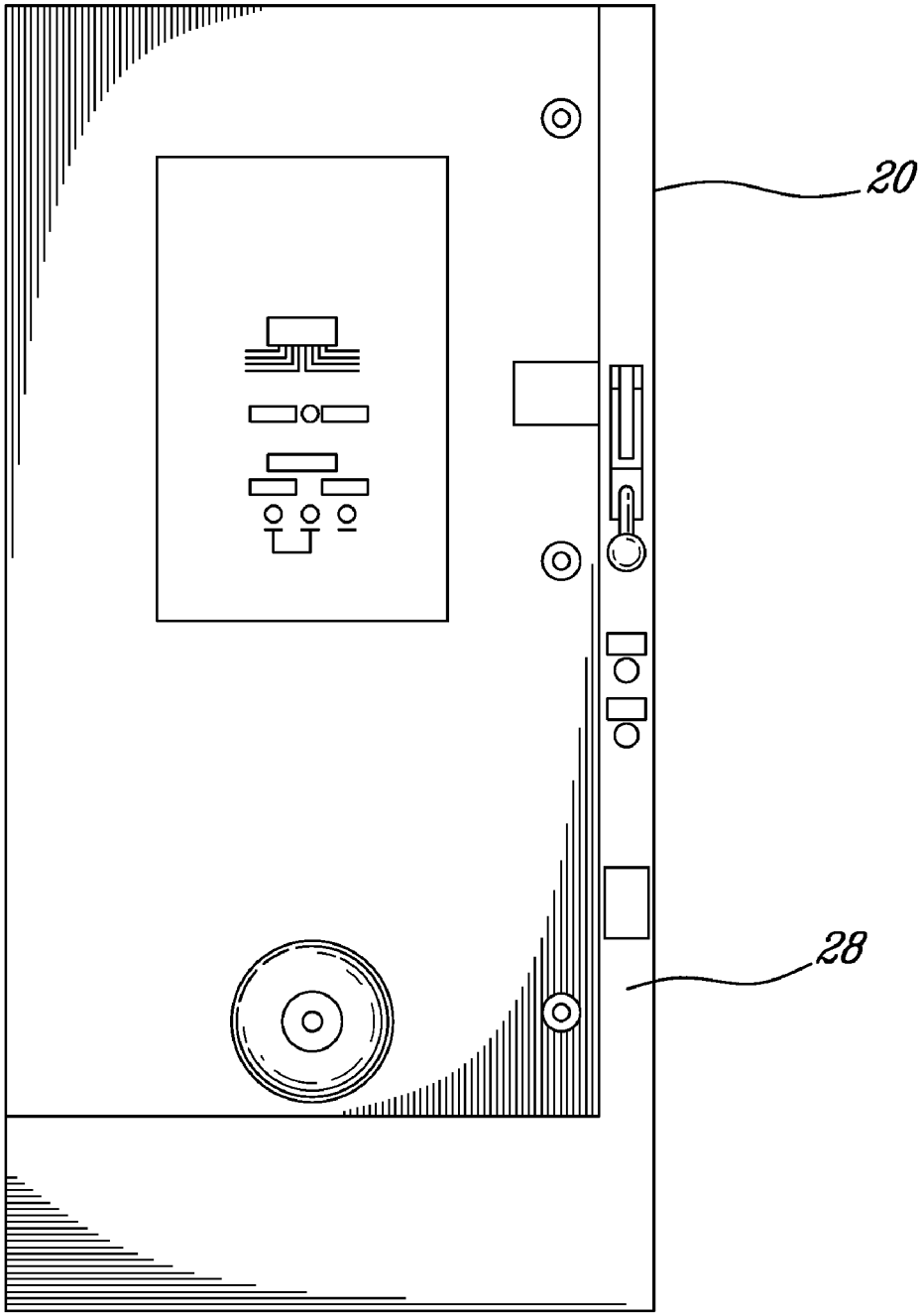
FIG. 2 is a perspective view of a fire pump controller.

Referring now to FIG. 2, a fire pump controller 20 equipped with a main power lever 21 and an emergency mechanical lever 28 accessible from the exterior of the controller 20 is illustrated.

Figure 3:
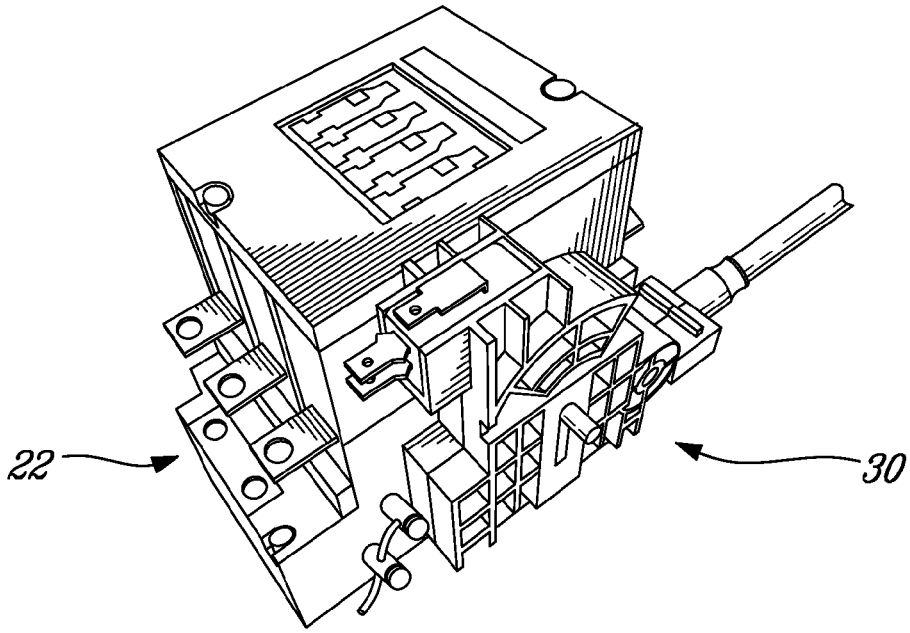
FIG. 3 is a perspective view of the side of a small contactor equipped with an illustrative embodiment of the present invention.
Figure 4:
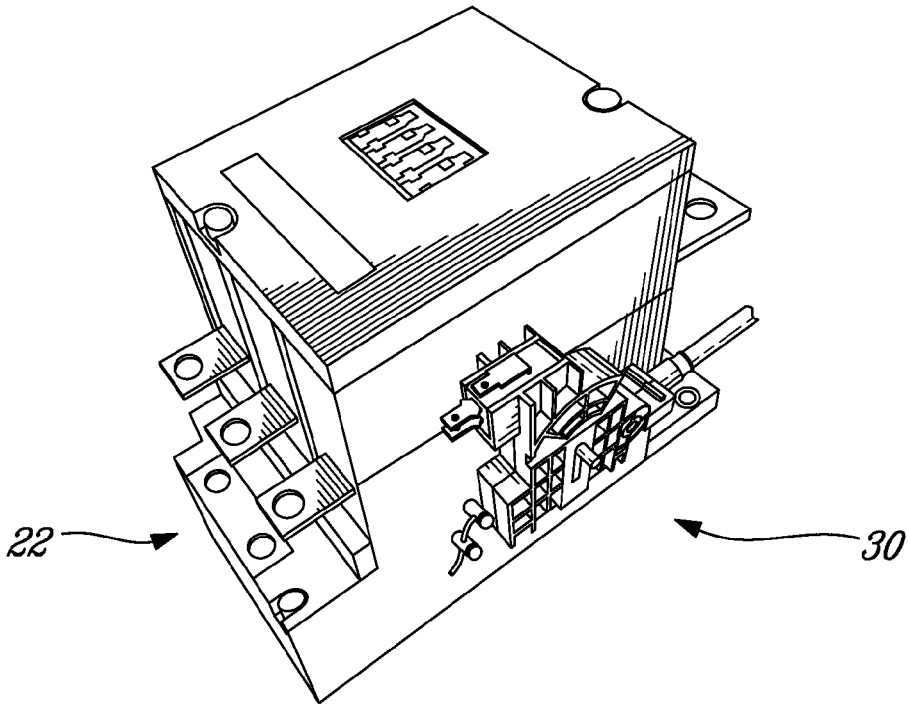
FIG. 4 is a perspective view of the side of a large contactor equipped with an illustrative embodiment of the present invention.

Referring to FIGS. 3 and 4, in addition to FIG. 2, the mechanical level 28 is connected to a cable 50. Therefore, pulling of the lever 28 mechanically activates the contactor 22 or a plurality of contactors (not shown) housed within the controller 20.

Now referring back to FIG. 3, an activator 30, in accordance with an illustrative embodiment of the present invention, is shown mounted to or "piggybacking" the side of an existing brand name manufactured contactor 22. The activator 30 may be mounted to a contactor 22 of various sizes, shapes and manufacturers. For example, and by referral to FIG. 4, an activator 30 is shown mounted on the side of a medium sized contactor 22 manufactured by Siemens.

Figure 5:
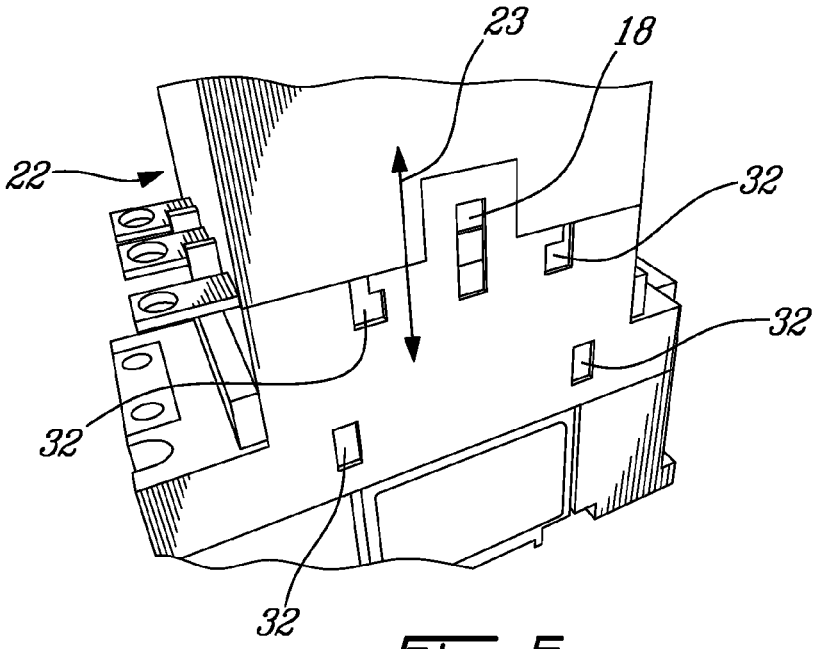
FIG. 5 is a perspective view of a contactor illustrating mounting points at which the present invention is attached.

Now referring to FIG. 5 in addition to FIG. 4, an activator 30 mounted to a contactor 22 by using mounting points 32 located on the side of contactor 22 is illustrated. In particular, FIG. 5 shows the standard mounting points 32 to which auxiliary contactors are attached and to which an activator 30 is similarly mounted. Generally, auxiliary contactors which employ these mounting points 32 are closed or opened by the motion of the armature and carrier assembly (not shown) of the contactor 22. A slider operating arm of an auxiliary contactor passing through an aperture 18 in the side of the housing of the contactor 22 engages the carrier of the armature (not shown). As the armature of the contactor 22 moves under the influence of an electromagnet employed to close and open the contactor 22 during normal operation, the carrier will cause the slider operating arm to move in the same direction as the armature, a direction as illustrated by arrow 23. The movement of the slider occasioned by the movement of the operating arm causes the contacts of an auxiliary contact to open or close. Similarly, the contacts of a contactor 22 may be opened or closed in a reverse manner by applying a force to a slider operating arm which moves the armature and carrier assembly. The activator 30 of the present invention is capable of engaging an aperture 18 of a contactor 22 so as to occasion the movement of the armature and carrier assembly and thereby control the opening or closing of the contacts of the contactor 22.

Figure 6:
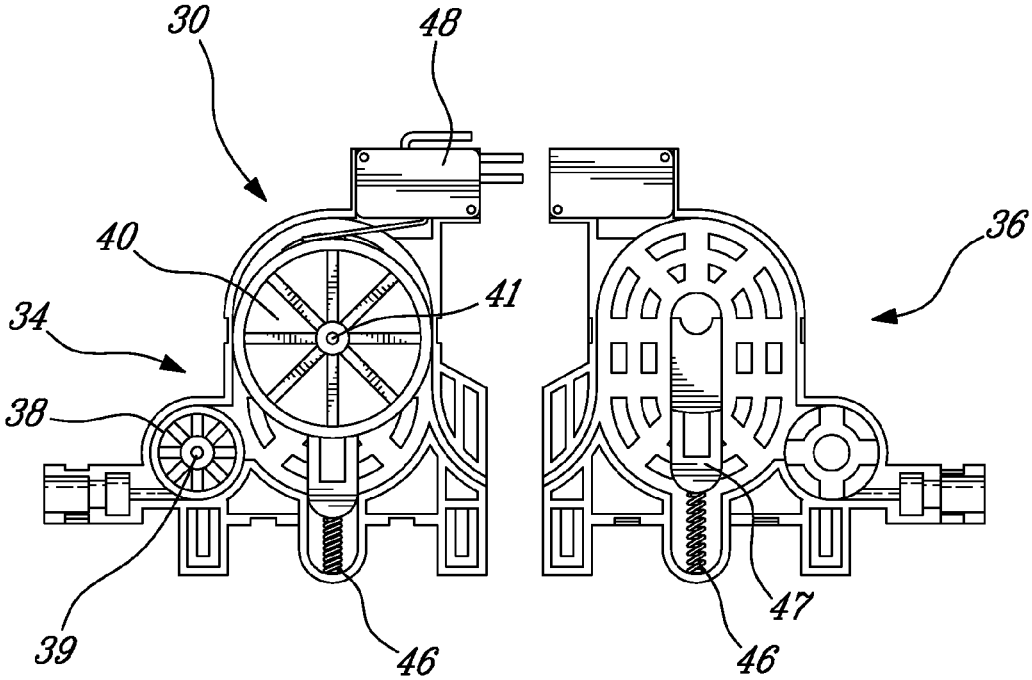
FIG. 6 is an exploded view of an activator in accordance with an illustrative embodiment of the present invention.
Figure 7:
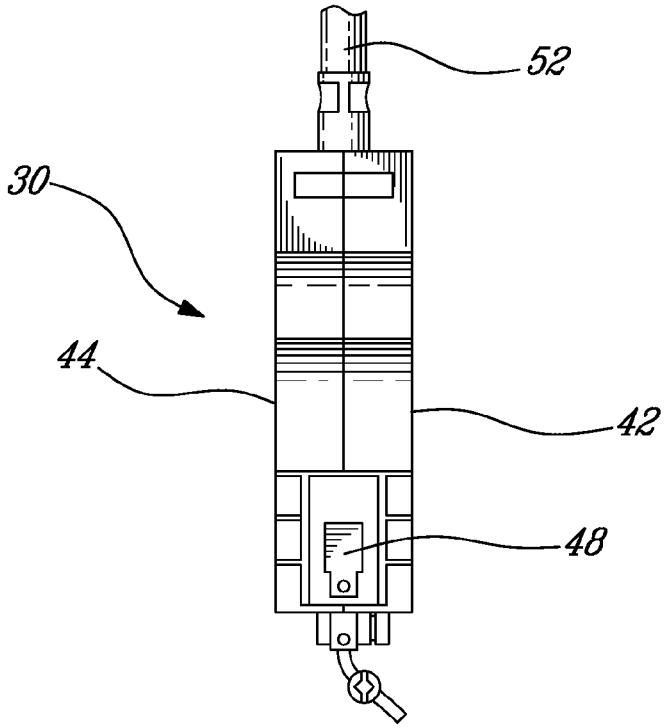
FIG. 7 is a top view of the activator.

Now referring to FIG. 6 and FIG. 7, an activator 30, in accordance with an illustrative embodiment of the present invention, comprises a housing further comprising a left casing 34 and a right casing 36, a left slider operating arm 42 and a right slider operating arm 44 extending on both sides of the left casing 34 and the right casing 36, a microswitch 48, and a pulley system further comprising a small pulley 38 with a fixed axle 39 and a large pulley 40 with a free axle 41 moveable within a channel guide 47 and biased by compression springs 46.

Figure 8:
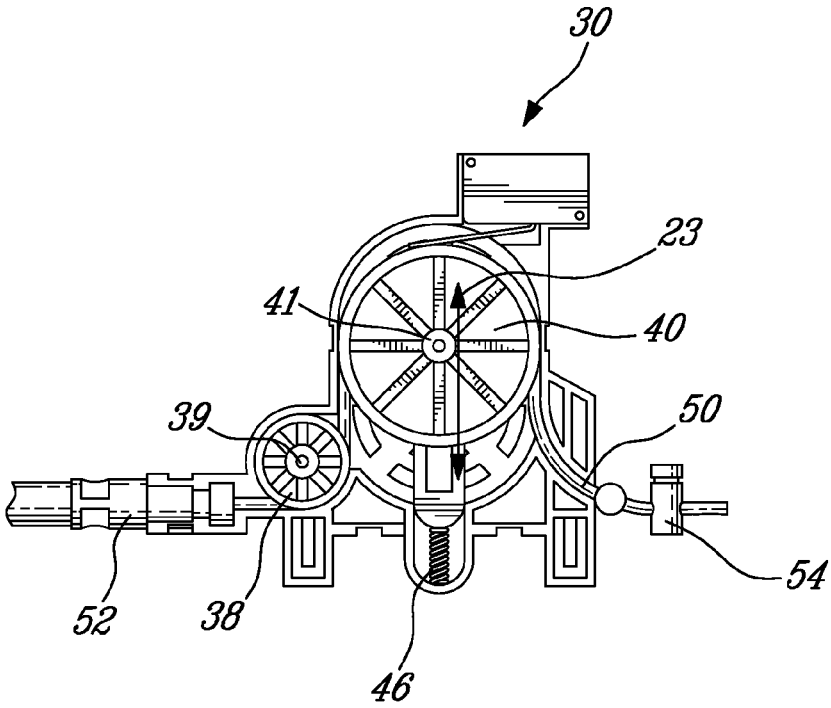
FIG. 8 is an exploded view of the activator in a disengaged position in accordance with an illustrative embodiment of the present invention.

Now referring to FIG. 8, the activator 30 is illustratively positioned in a disengaged position. A cable 50 is shown routed under the small pulley 38 having a fixed axle 39 and over the large pulley 40 having a free axle 41 which is movable in a direction indicated by arrow 23. To ensure the cable 50 remains routed about the pulleys 38, 40, the cable sheath end 52 is securely held in place within an aperture of the housing to form an anchor point at a first end of the casings 34, 36 and is anchored to a second end of the casings 34, 36 by a securing screw 54 attached to the end of cable 50. As will be apparent to a person skilled in the art, although a securing screw 54 is illustratively employed to affix the cable 50 to the second end of the housing, any other suitable means for securing the cable 50 to the housing may be employed.

Figure 9:
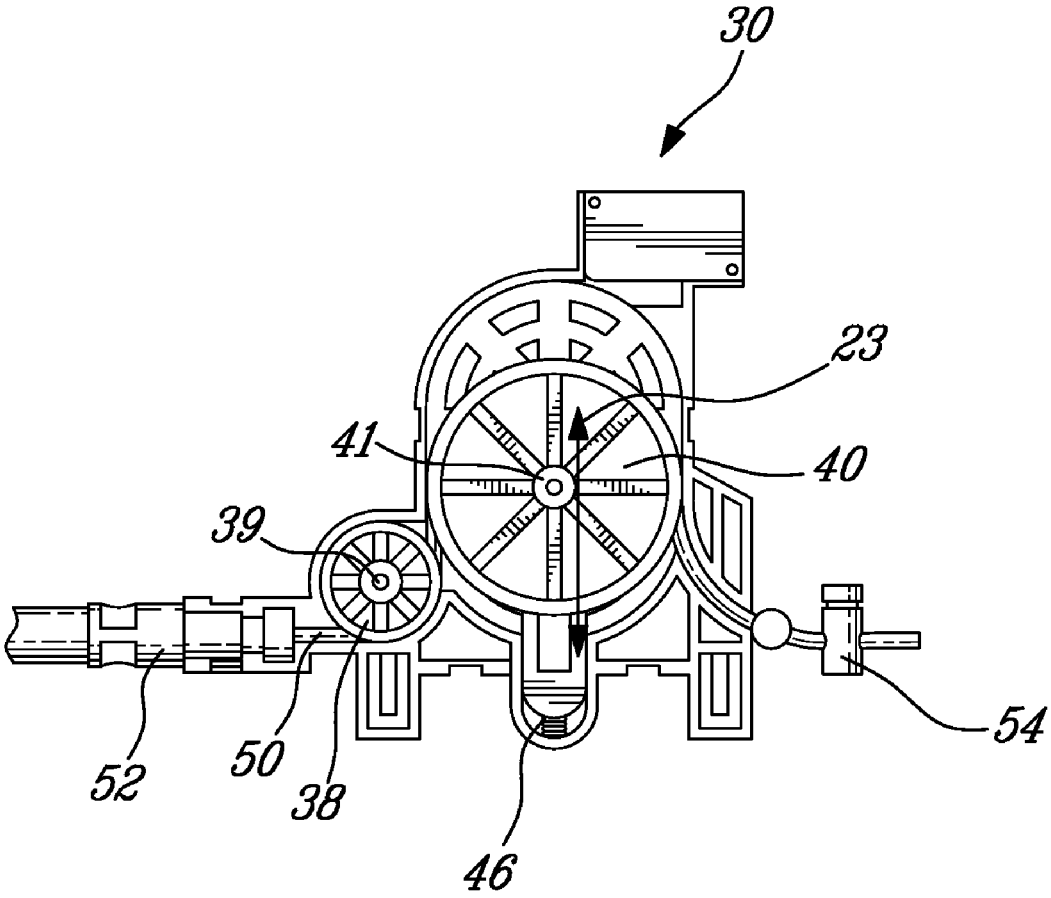
FIG. 9 is an exploded view of the activator in an engaged position in accordance with an illustrative embodiment of the present invention.

Now referring to FIG. 9, the activator 30 is illustratively positioned in an engaged position. In operation, an activator 30 is mounted to a contactor 22 at the mounting points 32 such that a left slider operating arm 42 or a right slider operating arm 44 engages and is fully seated within a contactor aperture 18. As the left slider operating arm 42 and the right slider operating arm 44 extend on both sides of the casing 34, 36, and according to another alternative embodiment of the present invention, the arms 42 and 44 may simultaneously engage the contactor apertures 18 of two adjacent contactors 22. When the mechanical lever 28 (shown in FIG. 2) is pulled by a user, the cable 50 is drawn taught between the lever 28 and the second anchor point and thereby forces the large pulley 40 to move downwardly in a direction indicated by arrow 23 from a disengaged position to an engaged position. As the large pulley 40 transitions from a disengaged to an engaged position, it is guided by its axle 41 which follows a channel 47 formed in the casings 34, 36. Furthermore, as the large pulley 40 is forced downward by the cable 50, the axle 41 simultaneously forces the left arm 42 and the right arm 44 (not shown) to follow the movement of the large pulley 40. Since the slider operational arms 42, 44 engage the aperture 18 and the carrier of the contactor 22, any movement of the arms 42, 44 causes a correspondingly similar movement of the contactor carrier; and vice versa, any movement of the contactor carrier 22 causes a corresponding movement of the arms 42, 44. Releasing the mechanical lever 28 (not shown) removes the stress in the cable 50 thereby causing the compression springs 46 to force the large pulley 40 and the slider operational arms 42, 44 to return to a disengaged position. The return of the slider operational arms 42, 44 in turn causes the contactor carrier to return to an open position.

Although the present invention has been described hereinabove by way of specific embodiments thereof, it can be modified, without departing from the spirit and nature of the subject invention as defined in the appended claims.

What is claimed is:

1. An activator for a contactor comprising a plurality of auxiliary contactor mounting points and a contact carrier, the activator comprising:

a compound pulley assembly adapted to receive a cable, said compound pulley assembly comprising a first pulley and a second pulley, said first pulley comprising a first radius and a fixed axle, said second pulley comprising a second radius and a free axle movable between a first position and a second position;

a spring for biasing said second pulley towards said first position;

an arm for engaging the contact carrier, said arm in cooperation with said free axle and movable from said first position to said second position as said second pulley moves from said first position to said second position;

a housing for encompassing said pulley assembly, said spring and said arm, said housing comprising a first housing end further comprising an aperture, a second housing end, and a plurality of mounting attachments for engaging the auxiliary contactor mounting points, wherein when said housing is mounted to the contactor said arm is engaged and aligned within the contact carrier; and a cable for engaging said first pulley and said second pulley, said cable comprising a first cable end and a second cable end, said second cable end accessible to said housing via said aperture, threaded about said compound pulley assembly and anchored to said second end;

wherein when a drawing force is applied to the said first cable end, said cable is drawn taut causing said second pulley to move from said first position wherein the contactor is open to said second position wherein the contactor is closed.

2. The activator of claim 1, further comprising a second arm in cooperation with said free axle for engaging a second contact carrier of a second adjacent contactor and further comprising a second plurality of mounting attachments for engaging the auxiliary contactor mounting points of said second contactor.

3. The activator of claim 1, further comprising a handle connected to said cable for applying a drawing force to said cable from outside a fire pump controller.

4. The activator of claim 1, wherein said second radius is larger than said first radius.

* * * * *